US007407467B2

(12) United States Patent
Diamond, Jr.

(10) Patent No.: US 7,407,467 B2
(45) Date of Patent: Aug. 5, 2008

(54) ABDOMINAL AND HAMSTRING MUSCLE STRENGTH CONDITIONING DEVICE

(76) Inventor: Jack Diamond, Jr., 27 Williamsburg Dr., Cheshire, CT (US) 06410

( * ) Notice: Subject to any disclaimer, the term of this patent is extended or adjusted under 35 U.S.C. 154(b) by 672 days.

(21) Appl. No.: 10/946,923

(22) Filed: Sep. 22, 2004

(65) Prior Publication Data

US 2005/0107225 A1 May 19, 2005

Related U.S. Application Data

(60) Provisional application No. 60/504,704, filed on Sep. 22, 2003.

(51) Int. Cl.
*A63B 21/00* (2006.01)

(52) U.S. Cl. ..... 482/121; 482/122; 482/127

(58) Field of Classification Search ..... 482/121, 482/124, 148, 907
See application file for complete search history.

(56) References Cited

U.S. PATENT DOCUMENTS 1,576,474 A * 3/1926 Walker ..... 482/126
5,957,820 A * 9/1999 Zarillo et al. ..... 482/121
6,231,487 B1 * 5/2001 Diamond et al. ..... 482/121

* cited by examiner

*Primary Examiner*—Jerome Donnelly
(74) *Attorney, Agent, or Firm*—McCormick, Paulding & Huber LLP

(57) ABSTRACT

A strength conditioning device for strengthening and conditioning abdominal and hamstring muscles is provided. The device includes at least one flex member, a seat, an ankle support attachment member and an ankle support frame. Each flex member has a first end portion, a second end portion and a middle portion between the first and second end portions, each middle portion having a curved region. The seat has an upper surface for receiving the buttocks and/or upper posterior thigh portions of a user and is attached to the second end portions of the flex members. The ankle support attachment member is attached to the first end portions of the flex members. The ankle support frame, which is attached to the ankle support attachment member, has left and right ankle support members oppositely positioned on either side of the flex members for supporting the ankles of the user. The device may further include a forefoot bar, attached to the ankle support frame, and configured to support the user's forefeet.

17 Claims, 14 Drawing Sheets

ABDOMINAL AND HAMSTRING MUSCLE STRENGTH CONDITIONING DEVICE

CROSS-REFERENCE TO RELATED APPLICATIONS

This application is entitled to the benefit of and incorporates by reference essential subject matter disclosed in Provisional Patent Application No. 60/504,704 filed on Sep. 22, 2003.

BACKGROUND OF THE INVENTION

1. Field of the Invention

The present invention relates to a device for exercising and strengthening muscles of the human body, in particular abdominal and hamstring muscles.

2. Technical Background

Abdominal weakness is a common problem. Physicians and personal trainers have advocated the use of the "sit-up" and/or exercise as a means of strengthening abdominal muscles. However, these conventional methods of sit-ups or crunches are ineffective and inefficient because they involve more of the hip-flexors than the abdominals. Conventional devices for exercising and strengthening abdominal muscles are inefficient because the effort expended by the users of such devices is predominately directed to exercising the hip flexor rather than strengthening the abdominal muscles. Furthermore, many conventional exercise devices overdevelop the hip flexors, particularly the iliopsoas, which can contribute to the pouching of the lower abdominal area.

Moreover, when a user attempts to do abdominal exercises, typically the user's knees do not remain stationary and either move up or down as the user is attempting to do a "sit-up". Thus, the user's ankles move either upward and/or away from the user's buttock. Often, the user attempts to compensate for this by exerting muscular force to hold his or her feet down to the floor, or by having a second person hold the user's feet stationary while the user does the sit-up exercises. One exercise device that overcomes such problems is described in U.S. Pat. No. 6,231,487, which issued on May 15, 2001 to Diamond, Jr. et al. and which is hereby incorporated by reference.

In addition to isolating the abdominal muscles from the hip flexors, it is also desirable to properly involve the hamstring muscles when performing abdominal curls, reverse curls and/or combined V-crunches. Contracting the hamstring muscles during abdominal exercises, when done properly, decreases the participation of the iliopsoas muscle and enables the increased participation of the rectus abdominis and the oblique muscles.

Thus, there is a need for an abdominal strength conditioning device that allows the user to also properly contract the hamstring muscles, without the assistance of an health care specialist, fitness expert, or spotter, when performing abdominal exercises such as the abdominal curl, reverse curl or combined V-crunch.

Additionally, not every user has the same level of strength or fitness. Moreover, the fitness level of any individual user may increase over time with the use of a strength conditioning device, such that fitness routines that were once difficult become easy and no longer provide a fitness challenge. Thus, there is also a need for an abdominal strength conditioning device that allows a user to vary the resistance levels associated with contracting the hamstring muscles and/or to increase conditioning levels by the placement of extra weights at strategic locations.

Furthermore, not every user has the same body dimensions and using a device that is too big or too small can lead to discomfort and even injuries. Thus, there is also a need for an abdominal strength conditioning device that can accommodate variations in different user's physical dimensions.

It is therefore an object of the present invention to provide a muscle conditioning device for exercising and strengthening abdominal muscles which solves the aforementioned problems related to traditional sit-up exercises and addresses the deficiencies of conventional devices.

Other objects and advantages of the present invention will in part be apparent from the drawings and the detailed description.

SUMMARY OF THE INVENTION

In a first embodiment, a strength conditioning device for strengthening and conditioning abdominal and hamstring muscles includes a plurality of flex members, a seat, an ankle support member and an ankle support frame. Each of the plurality of flex members has a first end portion, a second end portion and a middle portion between the first and second end portions, each middle portion having a curved region. The seat has an upper surface for receiving the buttocks and/or upper posterior thigh portions of a user, the seat being attached to the second end portions of the plurality of flex members. The ankle support attachment member is attached to the first end portions of the plurality of flex members. The ankle support frame is attached to the ankle support attachment member, the ankle support frame having left and right ankle support members oppositely positioned on either side of the flex member for supporting the ankles of the user.

In another embodiment, a strength conditioning device includes at least one flex member, a seat, an ankle support attachment member, an ankle support frame and a forefoot bar. The flex member has a first end portion, a second end portion and a middle portion between the first and second end portions, the middle portion having a curved region. The seat has an upper surface for receiving the buttocks and/or upper posterior thigh portions of a user and is attached to the second end portion of the flex member. The ankle support attachment member is attached to the first end portion of the flex member. The ankle support frame, which is attached to the ankle support attachment member, has left and right ankle support members oppositely positioned on either side of the flex members for supporting the ankles of the user. The forefoot bar is attached to the ankle support frame and is configured to support the user's forefeet.

BRIEF DESCRIPTION OF THE DRAWINGS

The figures are for illustration purposes only and are not drawn to scale. The invention itself, however, both as to organization and method of operation, may best be understood by reference to the detailed description that follows, in conjunction with the accompanying drawings, in which.

DETAILED DESCRIPTION OF THE INVENTION

Definitions

In order to facilitate understanding of the purpose and effectiveness of the present invention as well as the ensuing description, the terms shown below have been defined accordingly:

As used herein, the terms "abdominal muscles", "abdominals" or "rectus abdominals" refer to the muscles that connect the lower ribs and xiphoid to the pubic bone. These muscles allow flexing of the spine (curling the trunk) and cause the pelvis to posteriorly tilt.

As used herein, the terms "obliques" and "transverse abdominus" refer to groups of muscles that are located on the side of the abdominal muscles. The obliques and transverse abdominus cooperate to flex the spine and pull in or retract the stomach. Unilaterally, the obliques and transverse abdominus flex the spine laterally and obliquely.

As used herein, the term "psoas" or "iliopsoas", refers to muscles that are located anterior to the pelvis and inserted on the lumbar spine to the femur. The "psoas" are relatively stronger than the abdominals. The psoas muscles allow flexing of the spine and femur in a forward direction.

As used herein, the term "hamstring" or "hamstrings" refers to the muscles in the leg that extend the femur backwards and cause the pelvis to posteriorly tilt. When the hamstrings are contracted, they contribute to the inhibition of the psoas muscles and rectus femoris.

As used herein, the term "gluteus maximum", or "gluts" refer to the muscles that are located posterior to the pelvis and inserted on the pelvis to the femur. When the gluts contract, they can contribute to the inhibition of the psoas muscle.

As used herein, the term "rectus femoris" refers to muscles that are located anteriorly to the femor. These muscles flex the femor in the forward direction.

In describing the preferred embodiments of the present invention, reference will be made herein to FIGS. 1-22 of the drawings in which like numerals refer to like features of the invention.

Figure 1:
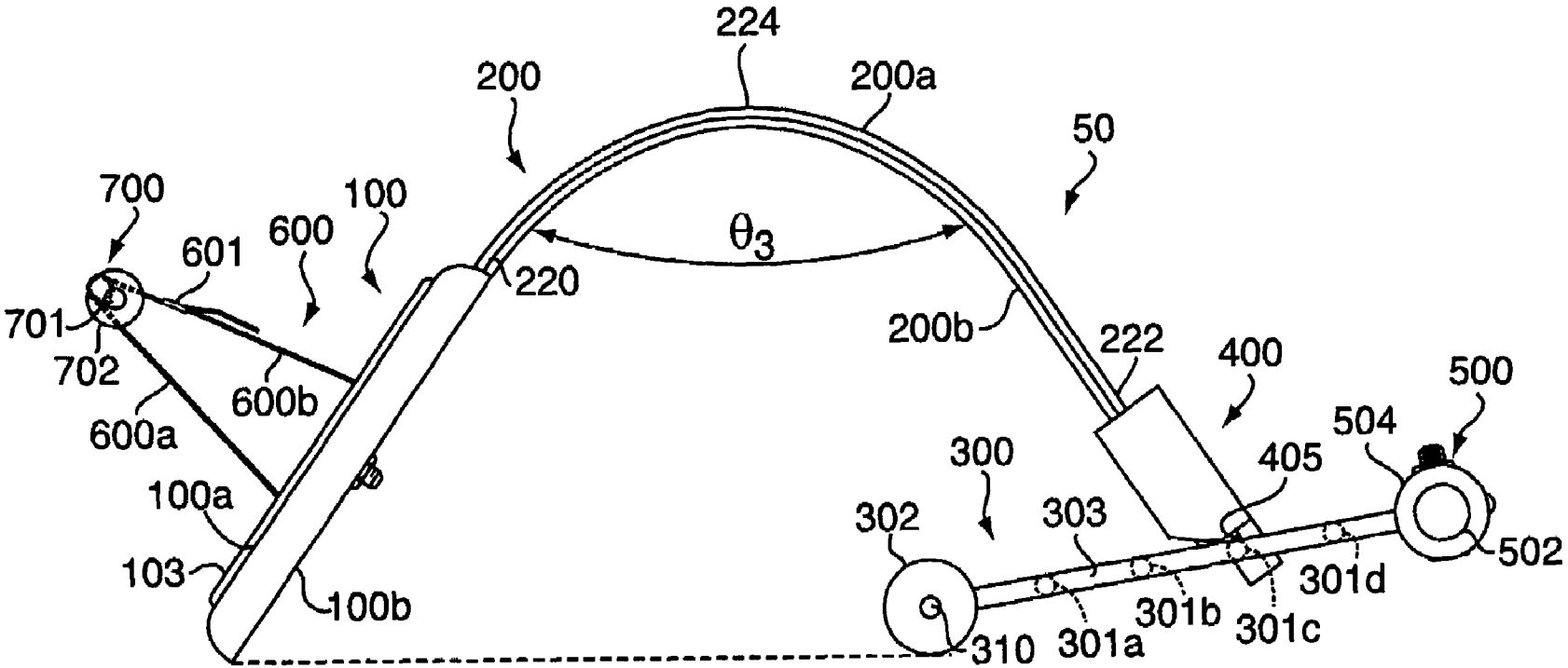
FIG. 1 is a side view of one embodiment of the strength conditioning device of the present invention with a first end of the flex members shown attached to seat 100 and a second end of the flex members attached to ankle support frame 300.

FIG. 1 shows one embodiment of the abdominal and hamstring muscle strength conditioning device of the present invention. Device 50 generally includes seat 100, flex member 200 and ankle support frame 300. Flex member 200 is coupled at one end to seat 100 and at its other end to ankle support frame 300. Ankle support frame 300 is attached to flex member 200 via ankle support attachment member 400. Forefoot bar 500 is shown coupled to ankle support frame 300. Seat strap 600 is attached to seat 100. Seat stabilizing thigh bar 700 is shown attached to seat strap 600.

FIG. 1 shows device 50 assembled with a first flex member 200*a*. A second flex member 200*b* is shown behind first flex member 200*a*. As shown in FIG. 1, second flex member 200*b* may be attached adjacent or underneath first flex member 200*a* to increase the resistance of device 50 to flexing. FIG. 1 also shows stabilizing thigh bar 700 attached to seat 100 via seat strap 600.

Figure 2:
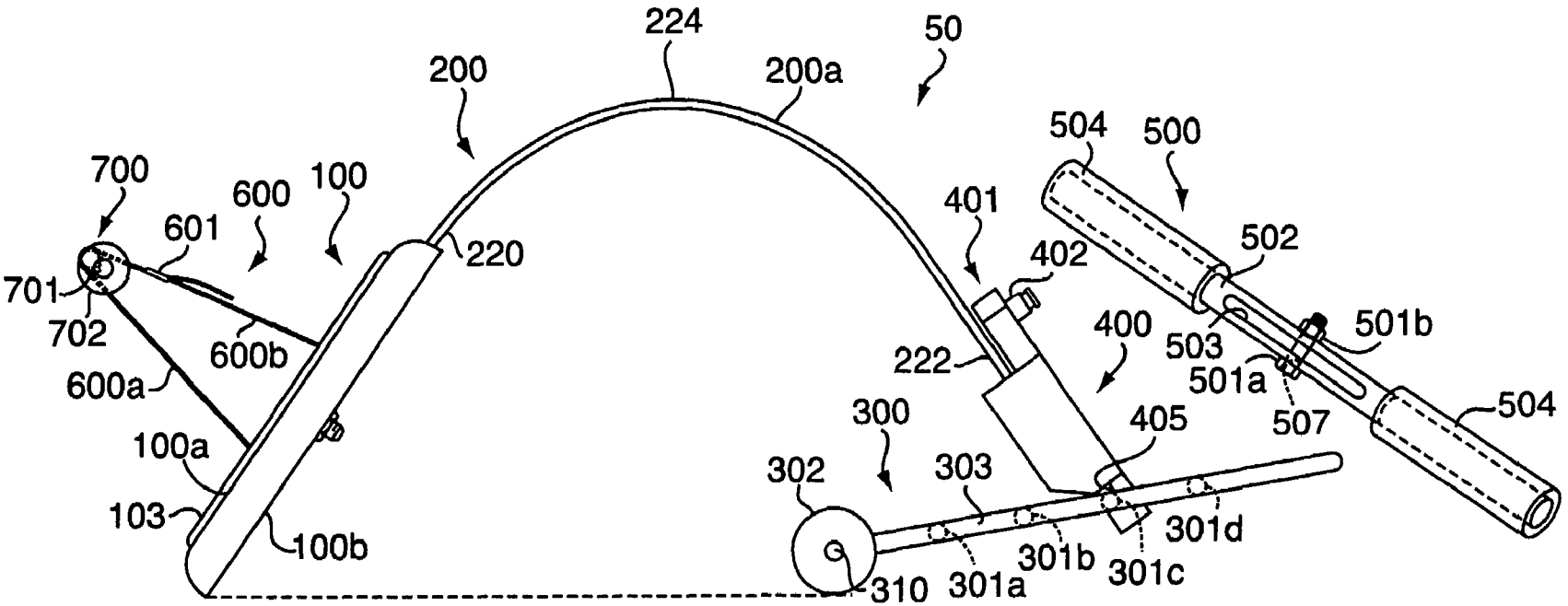
FIG. 2 is a side view of another embodiment of the strength conditioning device of the present invention.

FIG. 2 shows another embodiment of the muscle strength conditioning device of the present invention. In this embodiment, only a single flex member 200 is shown coupled at one end to seat 100 and at its other end to ankle support frame 300. In addition, weight attachment member 401 is shown coupled to ankle support attachment member 400 (weight 404 is not shown). Furthermore, forefoot bar 500 is shown detached from ankle support frame 300.

Figure 3:
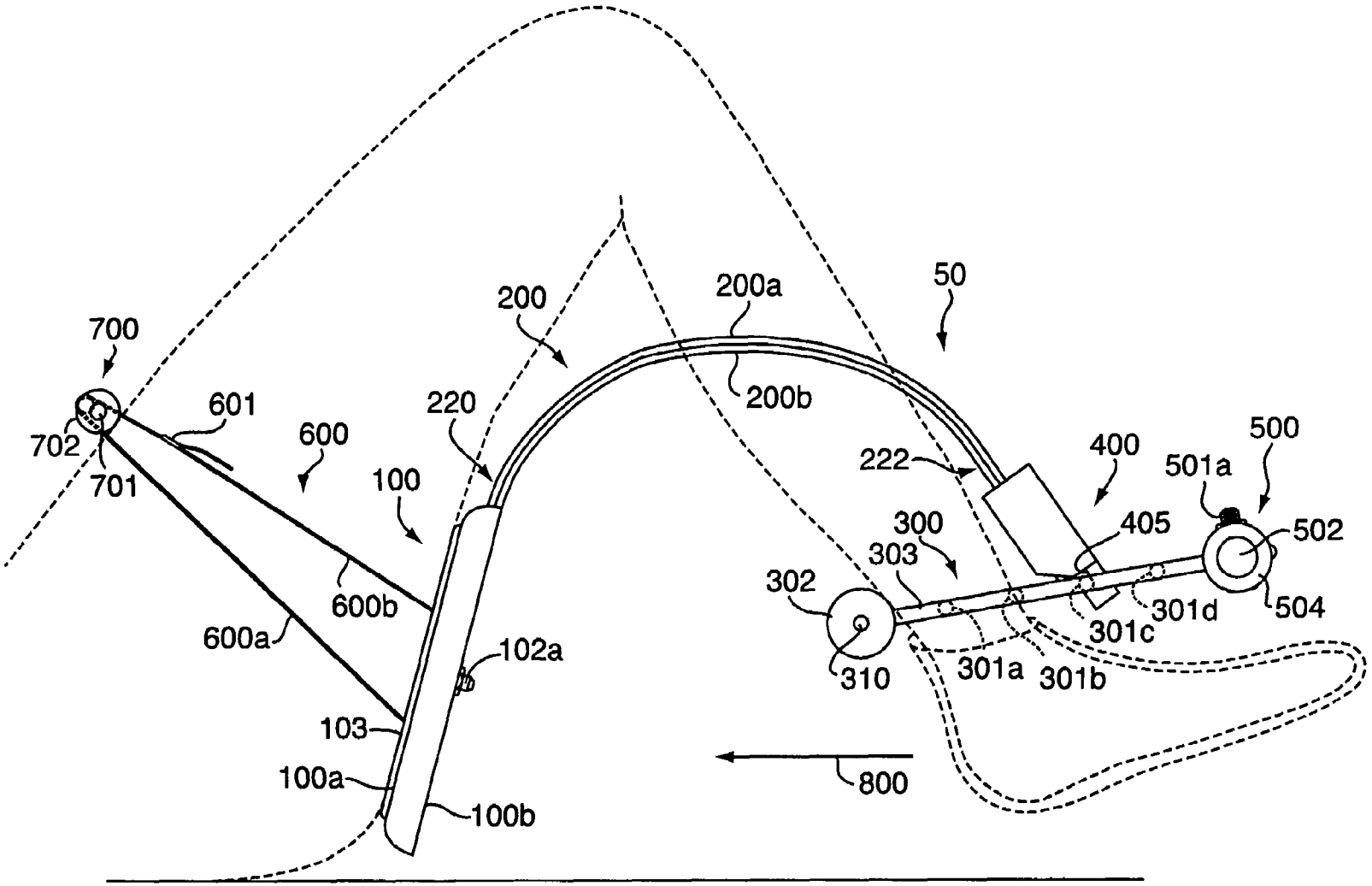
FIG. 3 illustrates one method of using the device of FIG. 1.

In FIG. 3, one embodiment of the muscle strength conditioning device of the present invention is shown in position with a user (shown in dashed lines). Seat 100 is positioned behind the gluteal (buttocks) and/or hamstring muscles. Stabilizing thigh bar 700 combined with seat strap 600 with buckle 601 holds the seat 100 in place for the user. Device 50 is shown with first and second flex members 200*a*, 200*b* attached to seat 100 and ankle frame attachment member 400. Ankle support frame 300 is attached to ankle frame attachment member and is positioned so that ankle support members 310 are located behind the Achilles tendon or above the calcanius or heel of the user. Ankle support members 310 are shown padded with foam cylinders or padding 302, which are positioned over and surround ankle support members 310. Padding 302 provides added comfort for the user. As shown in FIG. 3, the user squeezes device 50 by contracting the hamstring muscles, thereby moving the ankles and feet toward the gluteal or buttock muscles. The arrow 800 indicates the direction of force applied to device 50, which causes the flex members 200*a*, 200*b* to bend and first and second end portions 220, 222 of flex members to move closer together. When device 50 is squeezed, ankle support frame 300 pivots about the axle or pivot point 301*c*, which is pivotally positioned in channel 405 of ankle frame attachment member 400. Ankle support frame 300 may have more than one pivot point. In the embodiment shown in FIG. 3, ankle support frame 300 is provided with four pivot points 301*a*, 301*b*, 301*c*, 301*d*. Providing ankle support frame 300 with more than one pivot point allows the user to adjustably attach ankle support frame 300 to ankle frame attachment member 400, such that the distance between ankle support members 310 and the ankle frame attachment member 400 may be changed to accommodate variations in the leg length of different users.

Figure 4:
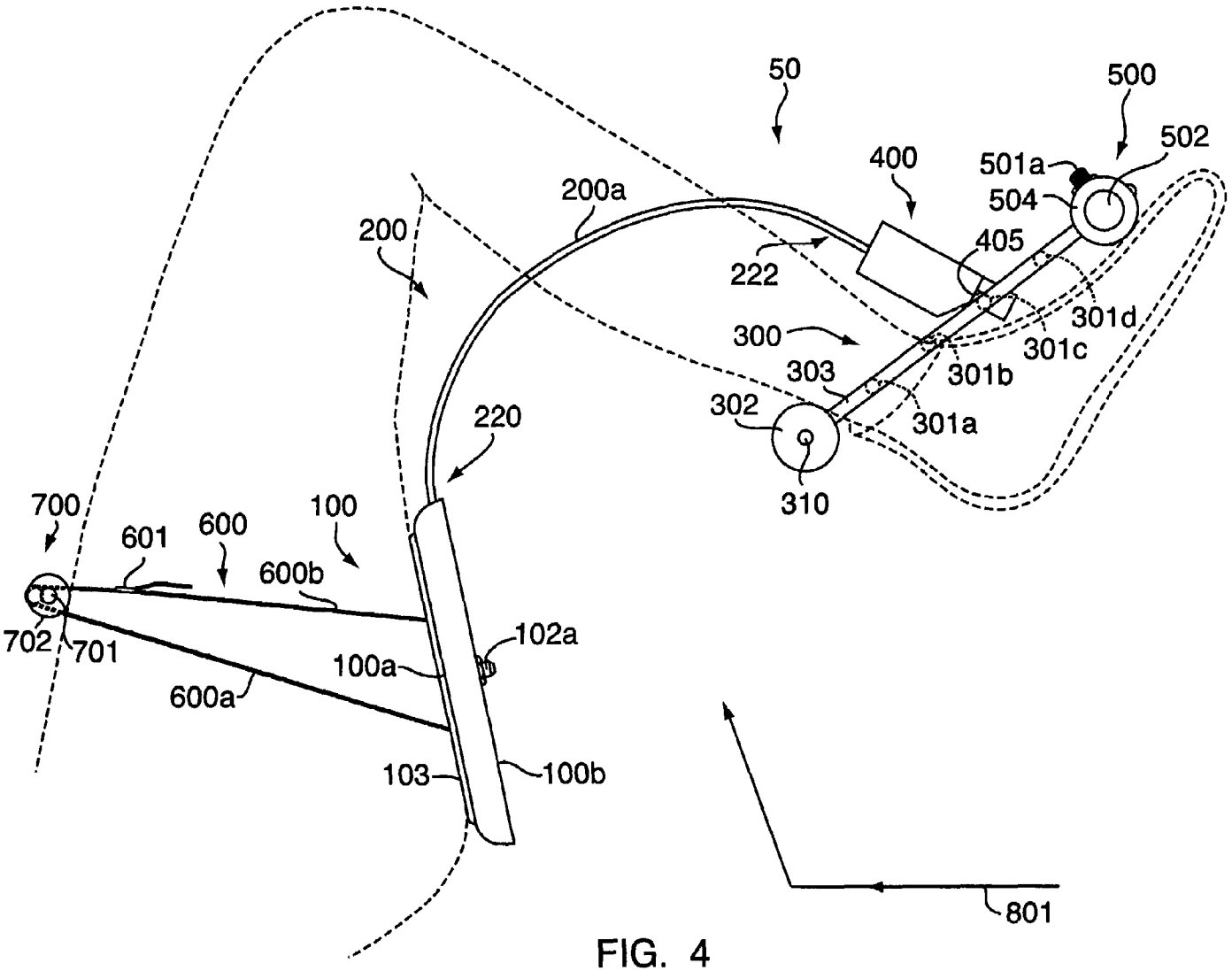
FIG. 4 illustrates another method of using the device of FIG. 1.

In an alternative embodiment shown in FIG. 4, only a single flex member 200 is attached to seat 100 and ankle frame attachment member 400. As in FIG. 3, the user squeezes device 50 by contracting the hamstring muscles, thereby moving the ankles and feet toward the gluteal or buttock muscles. A first, horizontal, portion of arrow 801 indicates the direction of force applied to device 50, which causes flex member 200 to bend and first and second end portions 220, 222 of flex member 200 to move closer together. In a second step, the user raises his legs. The direction of movement is indicated by a second, quasi-vertical, portion of arrow 801. This is the preferable position of the user's legs when reverse abdominal curls and/or V-crunches are performed. As with the embodiment shown in FIG. 3, when device 50 is squeezed, ankle support frame 300 pivots about the axle or pivot point 301*c*. However, when the user's legs are raised in direction 801, ankle support frame 300, in conjunction with the user's legs and feet, reacts to increased resistance and pivots around pivot point 301*c* such that forefoot bar 500 now rests against the top of the user's forefoot. Pivotable ankle support frame 300 and forefoot bar 500 allow maneuverability and provide increased support of the user's feet and ankles. FIG. 4 also shows how seat strap 600 combined with stabilizing thigh bar 700 helps to hold seat 100 and device 50 securely in place as the user squeezes device 50 and raises his legs.

Figure 5:
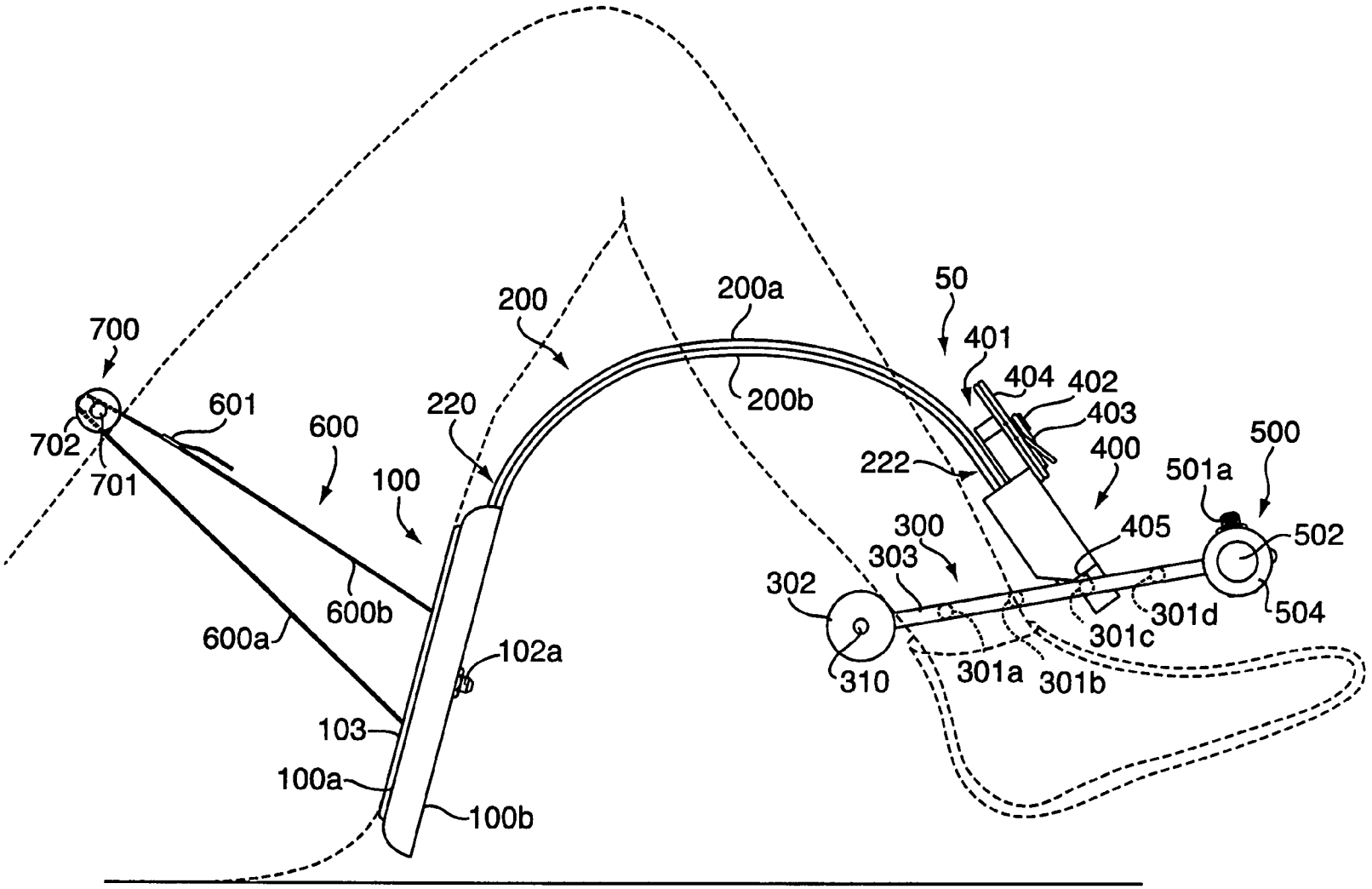
FIG. 5 illustrates a further method of using another embodiment of the device of the present invention.

In another embodiment of the present invention shown in FIG. 5, two flex members 200*a*, 200*b* are attached to seat 100 and ankle frame attachment member 400. In this embodiment, weight attachment member 401 is shown attached to ankle frame attachment member 400. Weight 404 is located on weight post 402 and secured with clip 403.

FIG. 1 shows seat 100 attached to a first end of both first flex member 200*a* and second flex member 200*b* and ankle support attachment member 400 attached to the second ends of first and second flex members 200*a*, 200*b*. FIG. 2 show seat 100 attached to a first end 220 of flex member 200 and ankle support attachment member 400 attached to a second end 222 of flex member 200. Ankle frame attachment member 400 is used to attach ankle support frame 300 to flex members 200*a*, 200*b*. Although not shown, it is to be understood that additional flex members 200 could also be attached between seat 100 and ankle support attachment member 400 to provide increased bending resistance. In a preferred embodiment, flex members 200 are made out of flexible plastic materials. However, flex members 200 can also be made out of fiberglass, spring steal, or any other suitable material that has sufficient elasticity and that provides the desired resistance.

Figure 17:
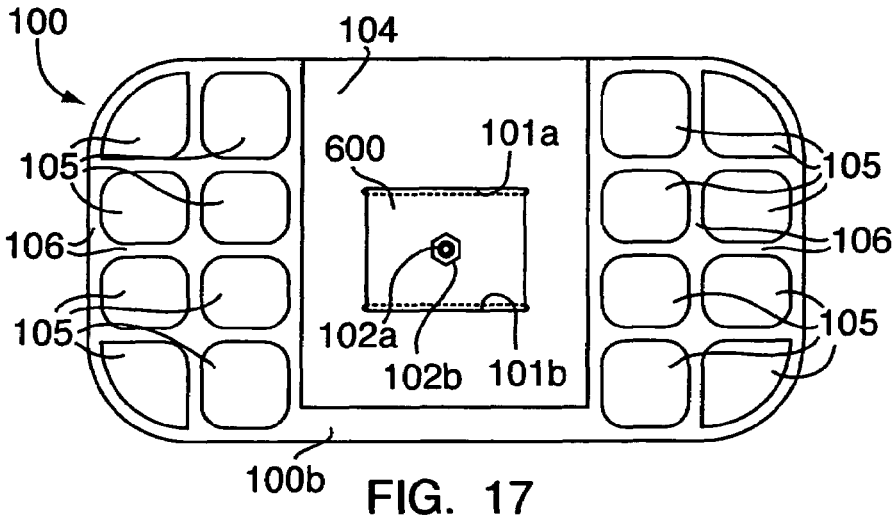
FIG. 17 is a bottom view of seat 100, showing the underside of seat 100 according to another embodiment of the present invention.

As best shown in FIGS. 3, 4 and 5, seat 100 contacts the buttocks and/or posterior thighs of the user. Seat 100 further includes top side 100*a* and bottom side 100*b*, opposite to side 100*a*. In one embodiment, side 100*b* has a recess 104 (as best shown in FIG. 17) that is sized for receiving end portions of flex members 200. The depth of recess 104 is substantially equal to the thickness(es) of the aforementioned end portions of the flex member(s). In one embodiment, seat 100 has a bore 111 therethrough that is designed to be aligned with corresponding bores or slots 211 (see FIG. 6) in flex members 200. An attachment device, such as a screw or bolt 102*a* is disposed through the seat bore 111 and through bore or slot 211 in flex member(s) 200 and is engaged with a nut, cotter pin or other engagement device 102*b* that retains bolt 102*a*. Bore 111 preferably has a countersunk opening so as to allow the head of bolt 102*a* to lie below surface 100*a* of seat 100. It is to be understood that other methods known to persons of ordinary skill in the art may be used to attach seat 100 to flex members 200.

Figure 16:
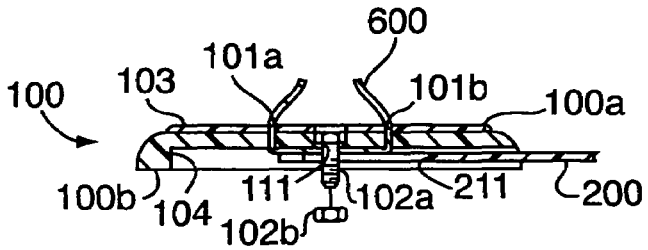
FIG. 16 is a side sectional view of seat 100 according to the embodiment of FIG. 15, shown with attachment bolt 102*a* and a partial view of seat strap 600.

Seat 100 has slots 101*a* and 101*b* that allow seat strap 600 with buckle 601 to loop through the seat 100. Slots 101*a* and 101*b* are located in a central portion of seat 100. In a preferred embodiment, seat strap 600 is secured to seat 100. As best shown in FIG. 16, flex member attachment bolt 102*a* may also be used to secure seat strap 600 to seat 100. Bolt 102*a* extends through a hole in seat strap 600 to prevent seat strap 600 from slipping when tightening the strap over the seat stabilizing thigh bar 700.

Figure 6:
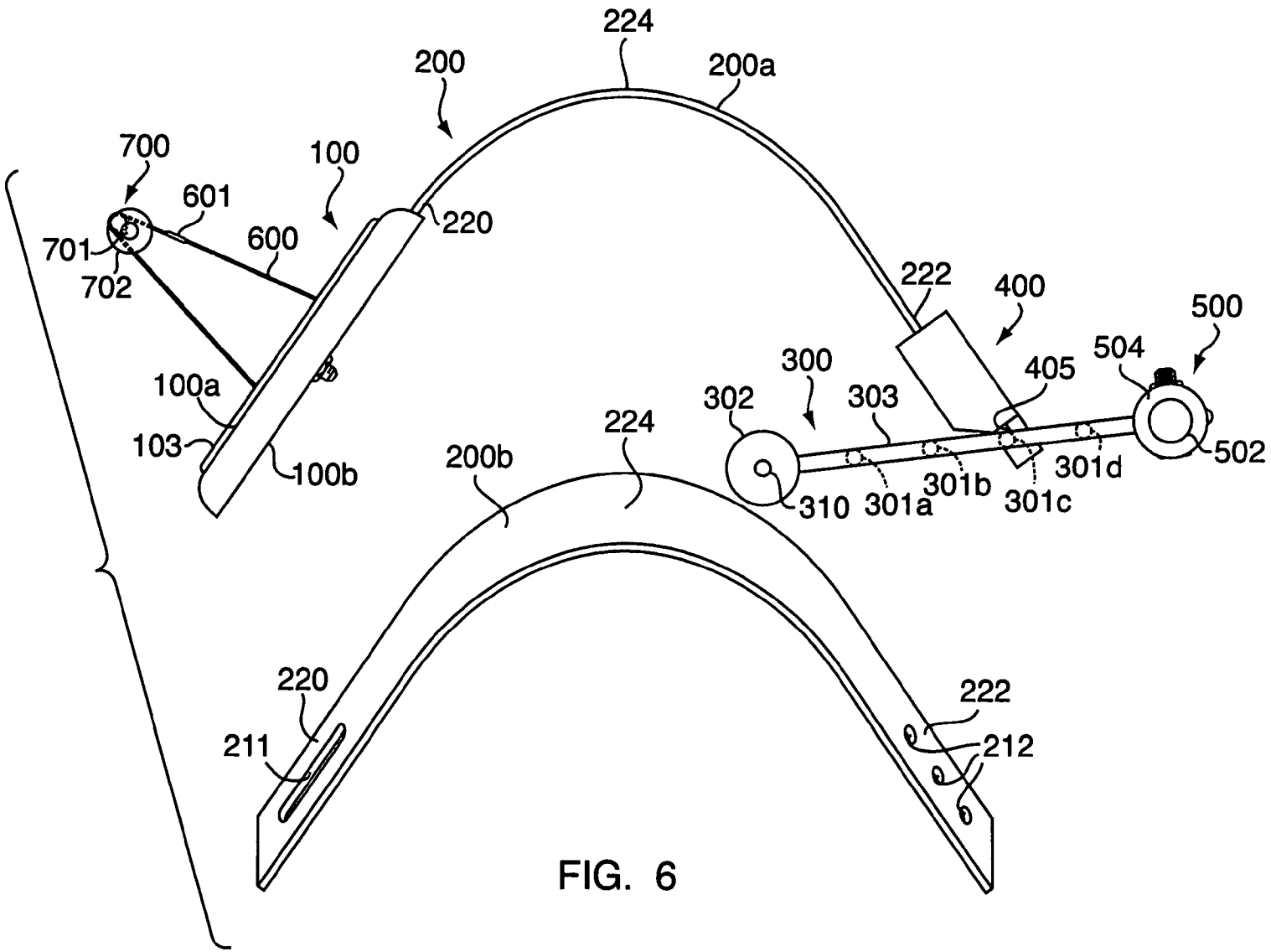
FIG. 6 is a side view of the device shown in FIG. 1 with second flex member 200*b* detached and shown in perspective.
Figure 18A:
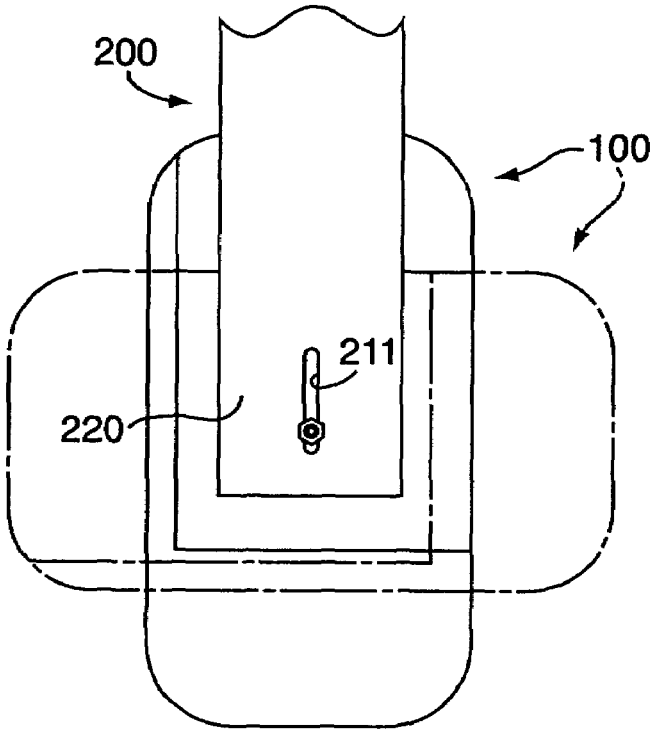
FIG. 18A is an underside view of seat 100, shown swiveled sideways in the storage position (and in the operating position in dashed lines) according to one embodiment of the present invention.

As shown in FIGS. 1, 3 and 5, second flex member 200*b* is positioned under first flex member 200*a*. As shown in FIG. 6, flex member 200 includes an elongated slotted hole 211 on end portion 220 for attachment to seat 100. At end portion 222, flex member 200 includes a series of holes 212 for attachment of flex member 200 to ankle frame attachment member 400. To aid in assembling the device, there may be an inscribed marking to denote the end portion to be attached to seat 100 and the end portion to be attached to ankle frame attachment member 400. Alternatively, flex member 200 may be designed such that either end may be attached to seat 100 and/or ankle frame attachment member 400. As another alternative, flex member 200 may be designed such that first end portion 220 differs from second end portion 222, such that only seat 100 may be attached to first end portion 220 and only ankle frame attachment member 400 may be attached to second end portion 222. Slot 211 allows seat 100 to be set at different relative positions along end portion 220 to both allow for the comfort of individual users and to allow user's to alter the bending resistance of device 50 by shortening or lengthening the active length of flex member 200. As shown in FIG. 18A and as will be discussed below, seat 100 can also be swiveled sideways to make storage or transport of device 50 more convenient. For instance, with seat 100 swiveled sideways device 50 may be stored under a bed or fit in a mid-size gym bag.

Figure 11:
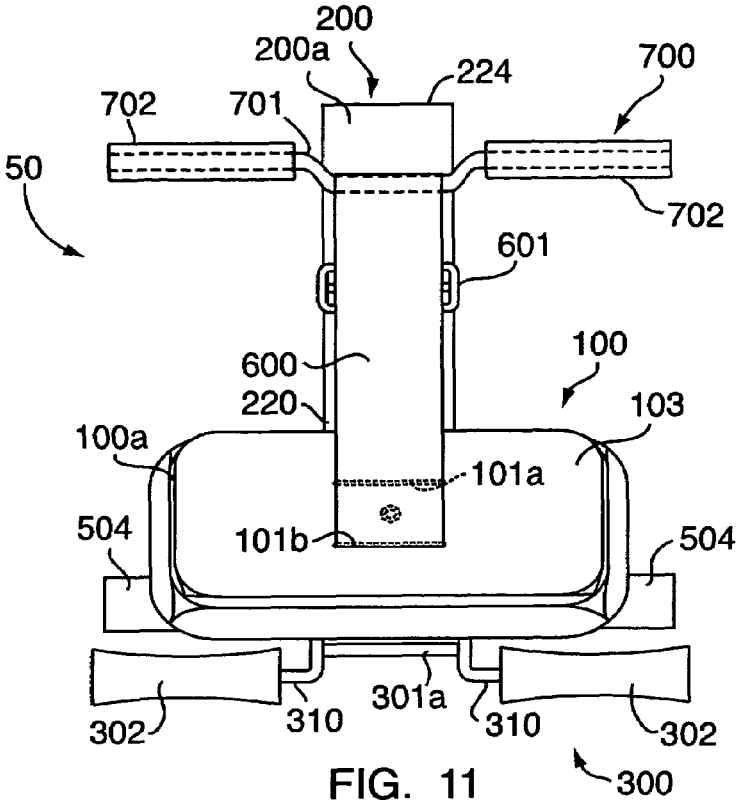
FIG. 11 is a front view of the device of FIG. 1.
Figure 12:
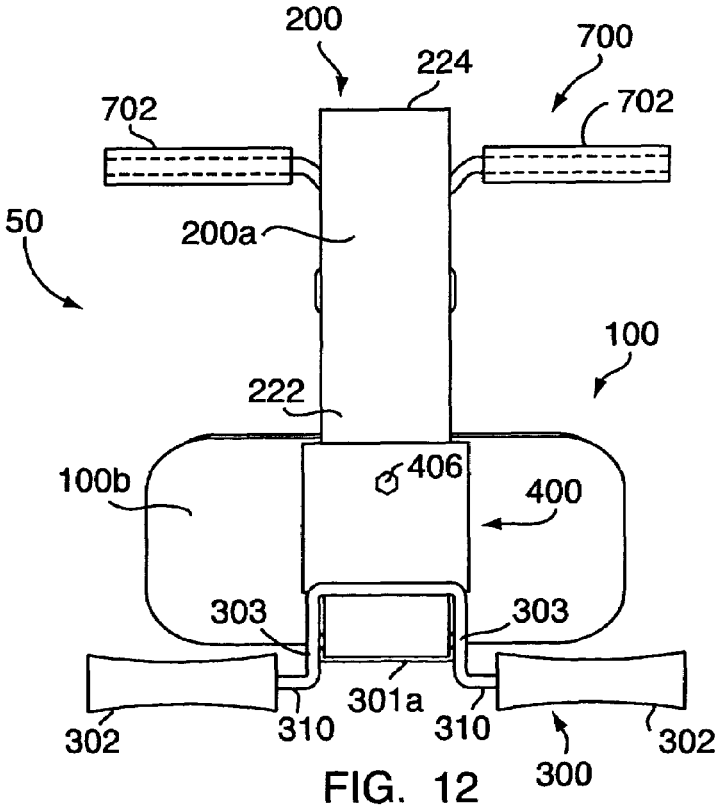
FIG. 12 is a rear view of the device of FIG. 1 with forefoot bar 500 removed according an embodiment of the present invention.

In FIG. 11, the position of stabilizing thigh bar 700, seat strap 600 in relation to seat 100 is shown. Seat strap slots 101*a*, 101*b* are located toward the center of seat 100 to better distribute the pressure of seat 100 during operation of device 50. In one embodiment, the pressure is distributed equally between the gluts and the hamstring muscles for better comfort when seat strap 600 is tightened.

Figure 15:
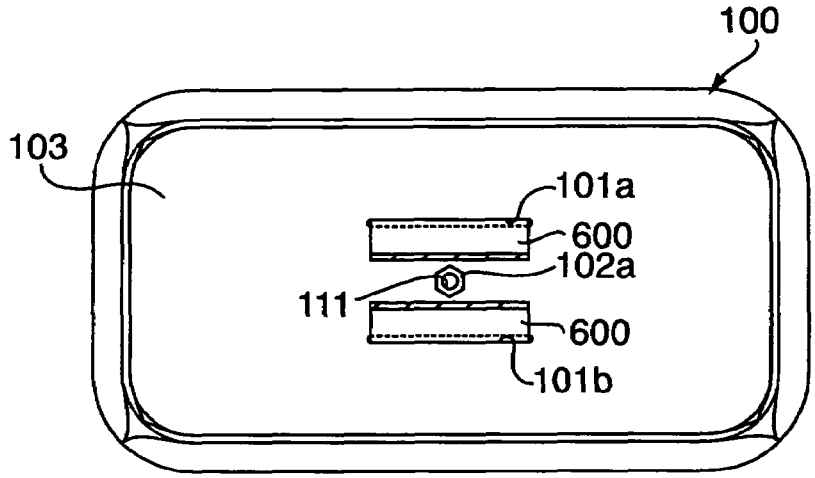
FIG. 15 is a top view of seat 100 according to an embodiment of the present invention.

FIGS. 15 and 16 show that the upper surface 101*a* of seat 100 may include padding 103 for the users' comfort. Padding 103 may be of any suitable material, including a resilient plastic, foam rubber, cloth, etc. Moreover, padding 103 may extend around the edges of seat 100. Further, padding 103 may be removable from seat 100. FIG. 15 also shows that the bore 111 for accommodating attachment bolt 102*a* may be located between slots 101*a*, 101*b*. If attachment bolt 102*a* has a hexagonally shaped head, a hexagonally shaped hole or countersink may be used to prevent attachment bolt 102*a* from turning when nut 102*b* is engaged. FIG. 16 also shows the curvature of seat 100, in particular the gently curve edges between top surface 100*a* and the bottom surface 100*b*. When a user squeezes device 50, the angles at the end portions of flex members 200 change. The curved edges of seat 100 compensate, at least in part, and ensure user comfort during flexing of flex members 200. FIG. 16 also shows that attachment bolt 102*a* may extend through a hole in seat strap 600 and that nut 102*b* mounts over seat strap 600. By having the seat strap bolted or otherwise secured to seat 100, seat strap 600 is prevented from slipping relative to seat 100 and a user is able to effectively tighten seat strap 600 while the user is positioned on seat 100.

FIG. 17 shows an embodiment of seat 100 that is both lightweight and stiff. FIG. 17 shows a plurality of cavities 105 separated by ribs 106. Cavities 105 reduce the weight of seat 100 compared to a solid seat. Ribs 106 provided added strength and stiffness to the lightweight seat. A central recessed cavity 104, which is typically larger than cavities 105, is provided to receive first end portion 220 of flex member(s) 200. The depth of central cavity 104, as seen in FIG. 16, may be such that one or more flex members 200 can be accommodated.

Figure 18B:
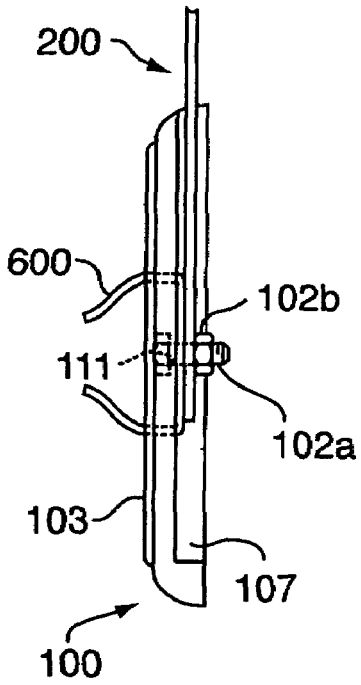
FIG. 18B is side view of seat 100 according to another embodiment of the present invention.

FIGS. 18A and 18B show an embodiment of seat 100 that provides the capability to swivel seat 100 from an operating position to a stored position. FIG. 18A shows seat 100 in a stored position in solid lines and in its operating position in dashed lines. Seat 100 has been swiveled 90 degrees between these two positions. In a preferred configuration shown in FIG. 18B, seat 100 swivels around attachment bolt 102. An indentation 107 for when the seat 100 is swiveled and locked into place for either storage under the bed or in the gym bag is shown. Attachment bolt 102*a* is tightened to keep seat 100 from moving when in the swiveled configuration.

In one embodiment, flex members 200 are substantially arch-shaped. Flex member 200 comprises end portions 220 and 222. Seat 100 is attached to seat end portion 220; ankle frame attachment member 400 is attached to ankle support end portion 222. Referring to FIG. 1, the midpoint of flex member 200 is designated generally by numeral 224. In a preferred embodiment, end portions 220 and 222 are angulated with respect to each other by angle $\theta_3$. In one embodiment, $\theta_3$ is between approximately 55 degrees and 70 degrees, inclusive. In another embodiment, $\theta_3$ is between approximately 58 degrees and 65 degrees, inclusive. In one embodiment, the lengths of end portions 220 and 222 are substantially equal. In another embodiment, the length of portion 220 is greater than portion 222. In a further embodiment, the length of portion 222 is greater than portion 220.

Flex members 200 are resilient and can be flexed or squeezed by applying a compressive force to end portions 220 and 222. The thickness of members 200 depends upon the required degree of resistance or resiliency. In a preferred embodiment, members 200 are solid therethrough and have a substantially rectangular cross-sectional shape in order to reduce torsional twisting of members 200. Members 200 are preferably made from durable, flexible materials such as plastic, ABS plastic, flexiglass, fiberglass, graphite or other composite materials. However, other materials having the required durability and flexibility may also be used.

Figure 13:
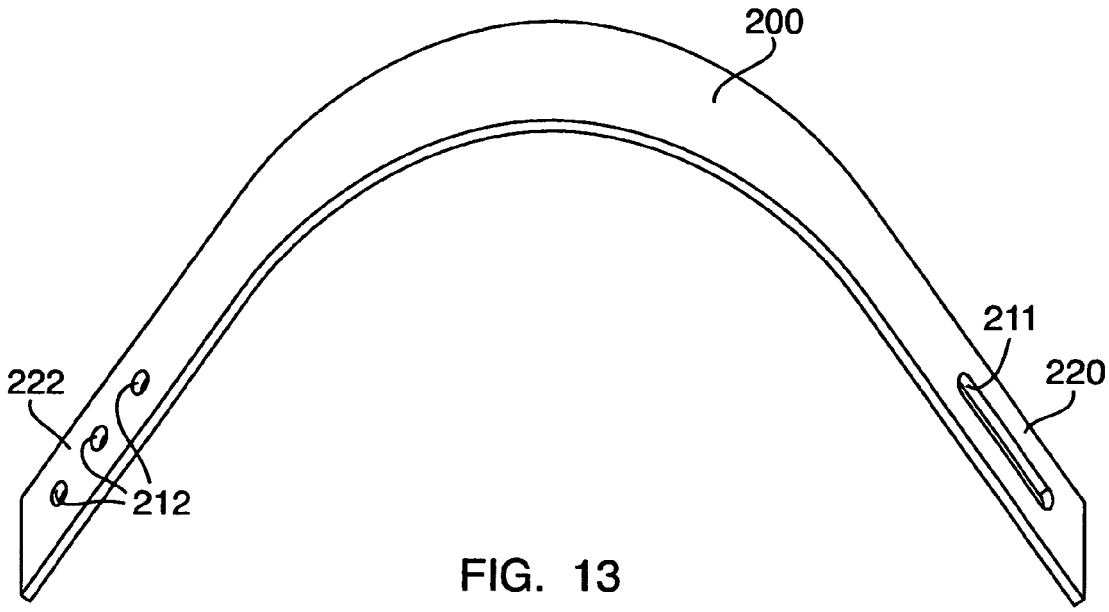
FIG. 13 is a side perspective view of flex member 200 according to one embodiment of the present invention.

As shown in FIG. 13, flex members 200 may be symmetric in shape. The angles at either end portion, when measured from a line connecting the two end portions, range from 50° to 60° (55° plus or minus 5°). The seat end portion 220 is shown with an elongated slot 211 for adjustability. The ankle support end portion 222 is shown with three holes 212 for accommodating the anklet attachment bolt 406.

Figure 14:
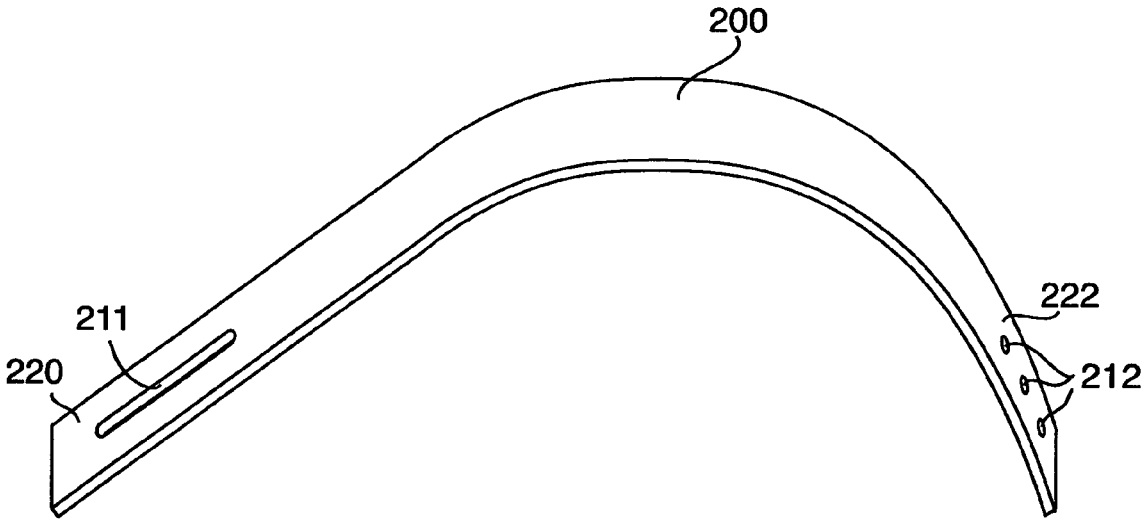
FIG. 14 is a side perspective view of flex member 200 according to another embodiment of the present invention.

As shown in FIG. 14, flex members 200 may be asymmetric in shape. For instance, the upper portion of the curve of the arch is approximately the same as the symmetric flex members 200 shown in FIG. 13, as is the seat end portion with the elongated slot 211. However, in this configuration, the ankle support end portion is shorter than the symmetric flex members. This asymmetric shape (being shorter along one leg than along the other) provides different flex characteristics than a symmetric flex member. In addition, the angles at either end portion may differ. For instance, the angle on the seat end portion may be approximately 50°, plus or minus 5°, while the angle on the ankle support end portion may be approximately 65°, plus or minus 5°.

Figure 19:
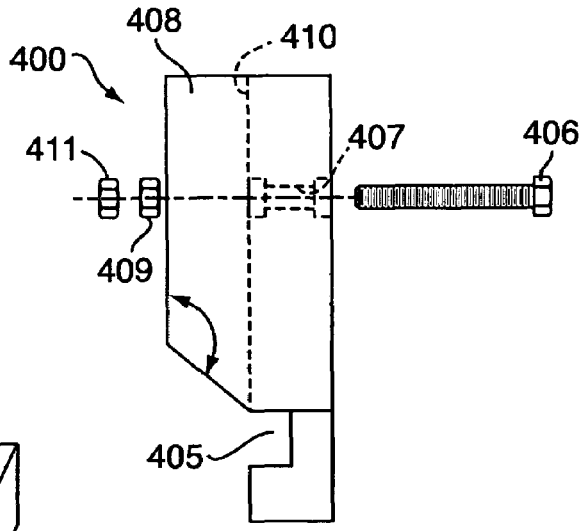
FIG. 19 is a partial exploded side view of ankle frame attachment member 400 according to one embodiment of the present invention.
Figure 20:
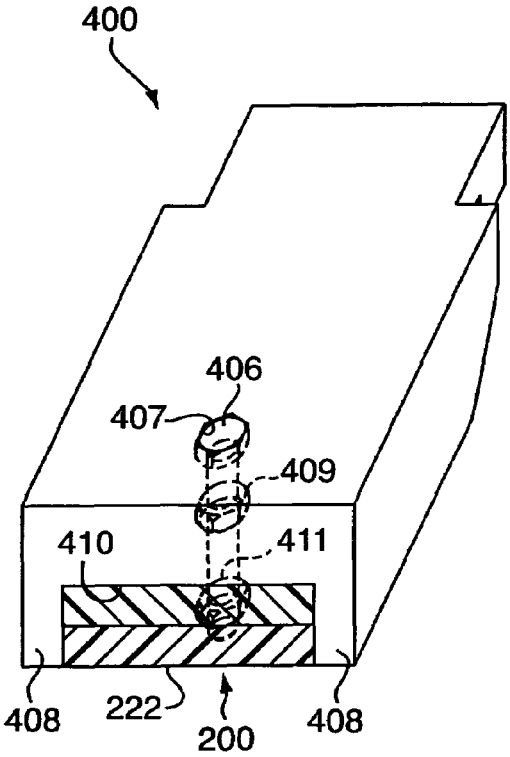
FIG. 20 is a top perspective view of the ankle frame attachment member 400 according to the embodiment of FIG. 19.
Figure 21:
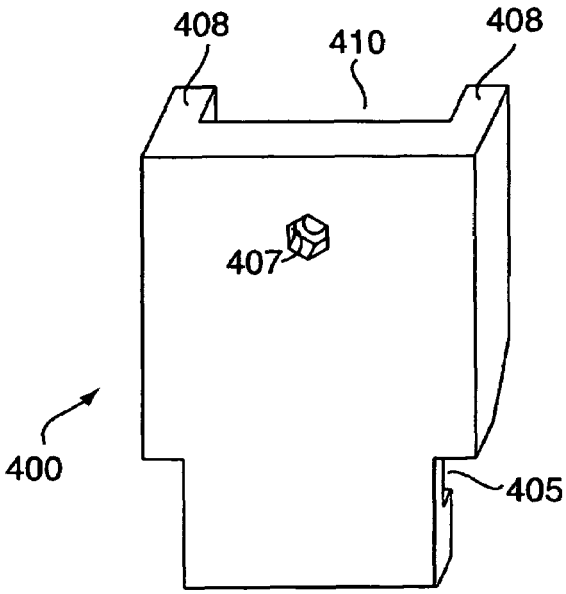
FIG. 21 is a side perspective view of the ankle frame attachment member 400 according to the embodiment of FIG. 19.

Flex members 200 are attached to ankle frame attachment member 400 at end portion 222. As shown in FIGS. 19-21, member 400 includes a channel 405 and a central cavity 410. Channel 405 accommodates pivot point members 301 of ankle support frame 300. Central cavity 410 accommodates the end portions 222 of flex members 200. Ankle frame attachment member may be made of metal, plastic, composite material or any other suitable material.

Referring to FIGS. 19-21, member 400 further includes side walls 408. Side walls 408 flank, and partially define, cavity 410. Side walls 408 prevent rotational or twisting movement of member 400 around bolt 406 with respect to flex members 200. Side walls 408 also facilitate the assembly of flex members 200 to member 400. Member 400 further includes a laterally extending channel 405 that is sized for receiving any of pivot point members 301*a-d* of ankle support frame 300 (see FIGS. 3, 4 and 5). Channel 405 is sized so as to allow frame 300 to pivot when secured between member 400 and portion 222 of flex members 200.

As shown in FIG. 19, the end of side wall 408, which is adjacent channel 405 and which forms a side of channel 405, lies at approximately a 90 degree angle (±5 degrees) with respect to the floor of channel 405. The end of side wall 408, which is adjacent channel 405 but which lies outside of channel 405, has an inclined or beveled end. In one embodiment, the beveled angle is approximately 120 degrees (±5 degrees). The degree of inclination of the ends of side walls 408 determines the angular range within which ankle support frame 300 can pivot around pivot point members 301*a-d*.

Through hole 407 accommodates attachment bolt 406, which secures one or more flex members 200 to member 400 (see FIG. 20). The opening of hole 407 may be countersunk to accommodate the head of bolt 406 and further may be shaped to restrain the head of bolt 406 from rotation. As shown in both FIGS. 19 and 20, bolt 406 extends through member 400 and is secured with inner nut 409. Inner nut 409 may have a flat profile. Alternatively, member 400 may be provided with a countersink for nut 409 (not shown). Bolt 406 then continues on and extends through holes 212 of flex members 200 and is secured with nut 411. Bolt 406 is long enough to accommodate a plurality of flex members 200.

Figure 9:
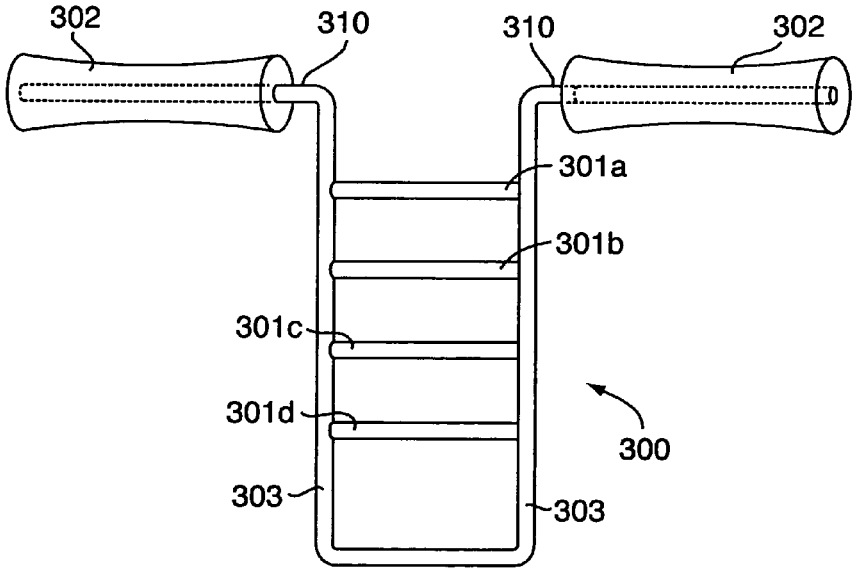
FIG. 9 is a perspective view of ankle support frame 300 according to an embodiment of the present invention.

Ankle support frame 300 is pivotally attached to ankle frame attachment member 400. Frame 300 may be fabricated from durable, lightweight materials such as aluminum, plastic, wood, fiberglass, graphite or other composite materials. As best shown in FIG. 9, support frame 300 includes a pair of substantially parallel members 303 with a plurality of pivot point members 301*a-d* extending therebetween. In addition to providing structural support, pivot point members 301*a-d* provide a plurality of different positions to which ankle support frame 300 can be pivotally located within channel 405 of frame attachment member 400. Thus, ankle support frame 300 is able to accommodate users of different sizes or heights. The angular position of support frame 300, with respect to frame attachment member 400 and flex members 200, also varies according to the degree of resistance produced when a user attempts to flex or squeeze device 50.

Also as shown in FIG. 9, ankle support frame 300 further includes elongate ankle support members 310 that are attached to and extend from parallel members 303. Ankle support members 310 stabilize the users' feet and ankles to facilitate proper use of device 50. In one embodiment, ankle pads 302 are provided on ankle support members 310. Ankle pads 302 each may have a generally cylindrical shape and define an axially extending bore that is sized to receive ankle support members 310. Ankle pads 302 may be foam or solid rubber, cloth, other foams or highly resilient plastics, or any other suitable material or combination of materials. Preferably, the overall structure of each ankle pad 302 is ergonomic so as to provide comfortable physical contact between the user's ankles and ankle support members 310 and to substantially eliminate stress and/or strain on the user's ankles. For example, pads 302 may be approximately ½" thick near their centers and ¾" thick towards their ends. This curved or flared design provides additional comfort and additional grip stability behind the ankle and/or above the heel.

Figure 7A:
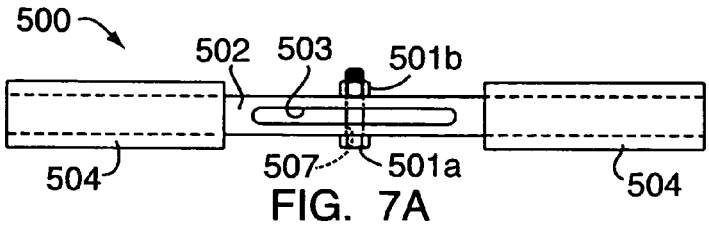
FIG. 7A is a front view of forefoot bar 500 according to another embodiment of the present invention.
Figure 7B:
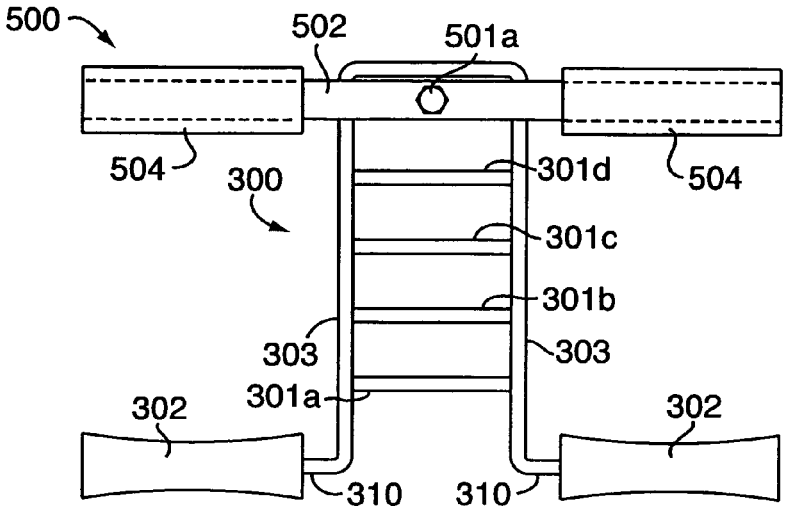
FIG. 7B is a front view of ankle support frame 300 with forefoot bar 500 in place, according to one embodiment of the present invention.
Figure 7C:
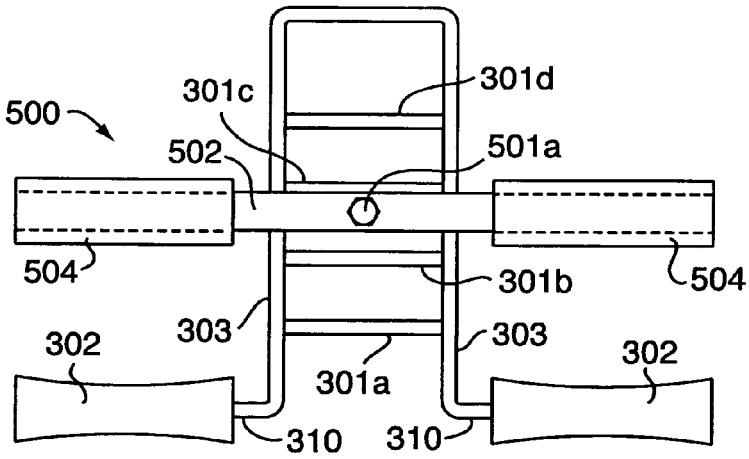
FIG. 7C is a front view of ankle support frame 300 with forefoot bar 500 in place according to another embodiment of the present invention.
Figure 7D:
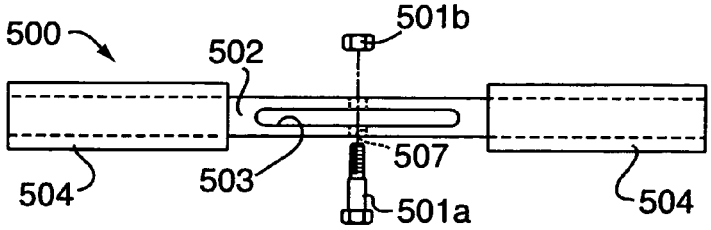
FIG. 7D is a front view of a detail of the attachment area of forefoot bar 500 to ankle support frame 300 according to an embodiment of the present invention.

As shown in FIGS. 7B and 7C, forefoot bar 500 may be adjustably attached to ankle support frame 300. Forefoot bar 500 may be positioned at different distances from the ankle support members 310 of ankle support frame 300. FIG. 7B shows forefoot bar positioned adjacent to the end of ankle support frame 300 that is opposite to the end supporting ankle support members 310. FIG. 7C shows forefoot bar 500 positioned near a midpoint of frame 300 and closer to ankle support members 310 than the position of FIG. 7B. The ability to adjustably position and attach forefoot bar 500 to ankle support frame 300 allows device 50 to better accommodate the various ankle and/or foot sizes of different users.

As best shown in FIG. 7A, forefoot bar 500 includes bar 502, forefoot pads 504, and slot 503. Clamping bolt 501*a* extends through holes in bar 502 where slot 503 is located. The hole in bar 502 for accommodating bolt 501*a* may be shaped such that the head or shank of bolt 501*a* is restrained from rotation. As shown in FIG. 8B, a square shaped hole 507 accommodates the square shank of bolt 501*a*. Bar 502 may be fabricated from plastic or any other suitable material. Forefoot pads 504 may be foam or solid rubber, cloth, other foams or highly resilient plastics, or any other suitable material or combination of materials. As with ankle pads 302, the overall structure of each forefoot pad 504 may be ergonomically designed so as to provide comfortable physical contact for the user's forefoot. Alternatively, forefoot pads may be fabricated of foam that surround the ends of bar 502 and has an approximate thickness of ¼ to ⅜ inches.

Figure 8A:
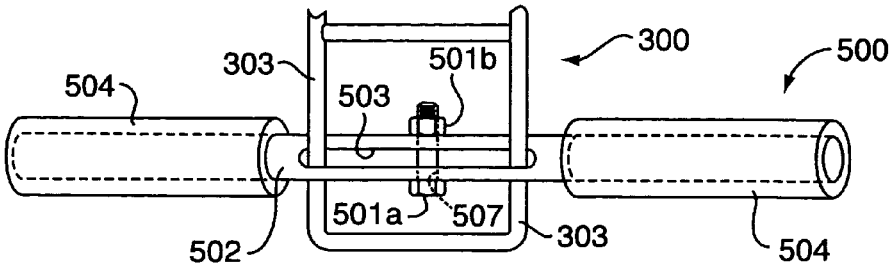
FIG. 8A is a perspective view of forefoot bar 500 attached to ankle support frame 300 according to one embodiment of the present invention.
Figure 8B:
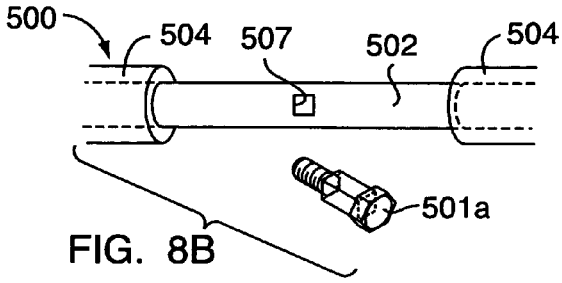
FIG. 8B is a top view of a detail of the forefoot bar of FIG. 9A with bolt 501*a* off to the side.

In FIG. 8A, forefoot bar 500 is shown with ankle support frame 300 positioned within slot 503. Forefoot bar 500 may be slid to any position along parallel members 303 of frame 300. When clamping bolt 501*a* is tightened, forefoot bar 500 becomes securely attached to frame 300. In the embodiment shown, tightening nut 501*b* on bolt 501*a* causes the sides of slot 503 to approach one another. Bar 502 in the vicinity of slot 503 is designed to allow slot 503 to be narrowed or pinched, such that bar 502 clamps around parallel members 303. Bar 502 may be made of resilient plastic.

Figure 22:
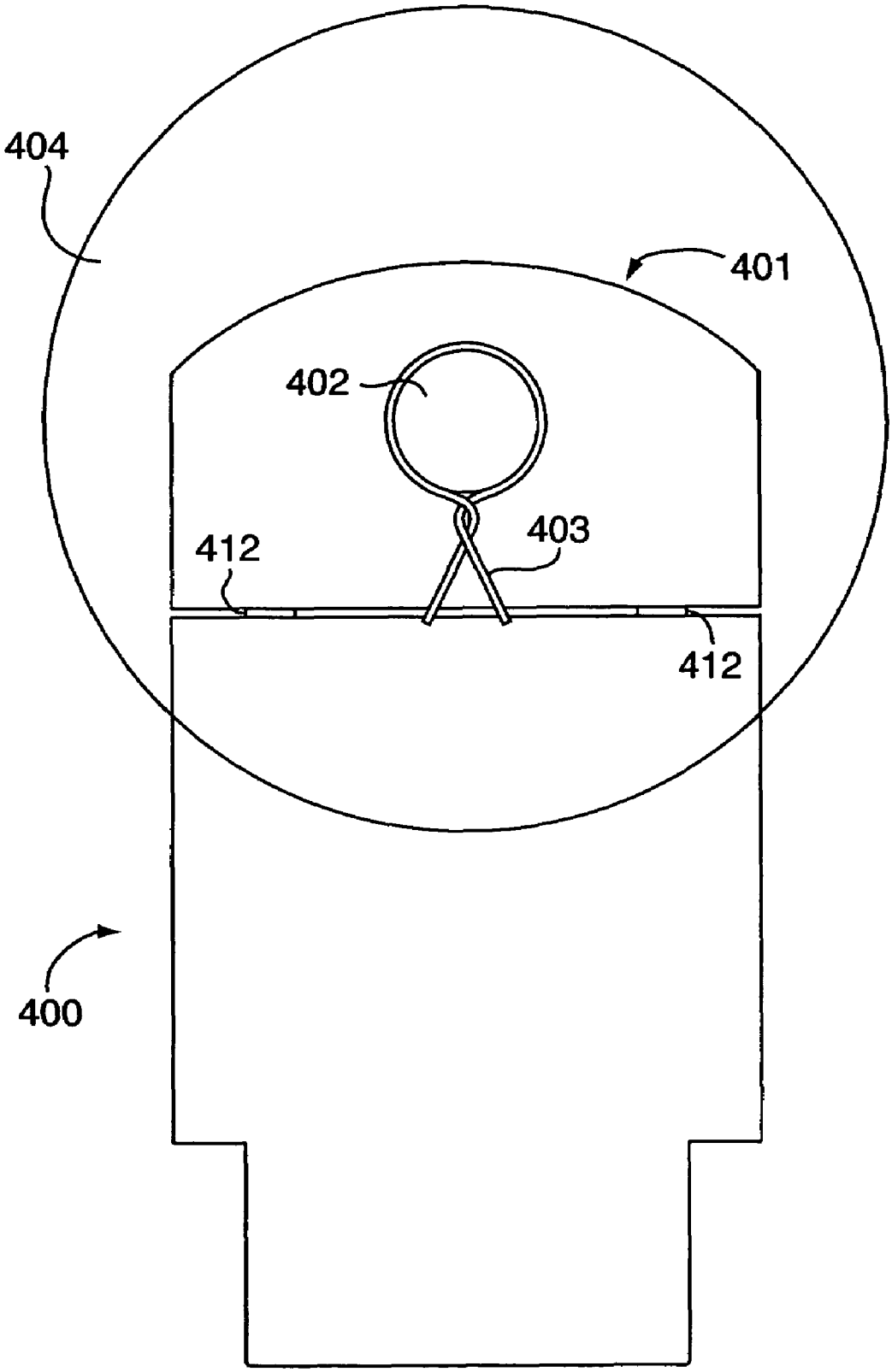
FIG. 22 is a front view of ankle frame attachment member 400, with attached transparent weight 404, according to the embodiment of FIG. 2.

To increase the intensity of the strength conditioning workout using device 50, additional weight may optionally be attached to ankle frame attachment member 400. As best shown in FIG. 22, weight attachment member 401 is attached to member 400. In one embodiment, weight attachment member 401 includes tabs 412, which snap into slots (not shown) in member 400. Post 402 extends from member 401 and is configured to accommodate corresponding holes in weights 404. In one embodiment, post 402 is located in a post hole (not shown) in member 401 and is provided with a flat bottom to prevent post 402 and weights 404 from falling off of member 401. After one or more weights 404 are positioned on post 402, the handle of clip 403 is positioned to lock weights 404 against weight attachment member 401.

Seat strap 600 and stabilizing thigh bar 700 enable the user to maintain seat 100 in firm, physical contact with the user's buttocks or rear portions of the user's thighs. As shown in FIG. 1, seat strap 600 is formed from two separate seat strap portions 600*a* and 600*b* with buckle 601 attached to strap portion 600*a*, seat stabilizing bar 700 is positioned with the loop formed by buckled seat strap 600. Seat strap 600 may be fabricated from leather, plastic, or textile materials, such as polyester, nylon, dacron, etc. In a preferred embodiment, seat strap 600 is adjustable, for instance by providing a plurality of spaced apart holes in strap portion 600*b* for allowing insertion of a pin from buckle 601, such that the overall length of the seat strap loop may be shortened or lengthened. Thus, seat stabilizing thigh bar 700 may be variably positioned a distance away from seat 100, allowing different users to adjust the position of stabilizing thigh bar 700 for maximum comfort and performance. Alternatively, seat strap 600 may be elastically stretchable to allow stabilizing thigh bar 700 to be variable positioned away from seat 100 by stretching strap 600, or seat strap 600 may have a sequential series of loops at the end away from seat 100, each loop sized to accommodate stabilizing thigh bar 700 and thereby allowing stabilizing thigh bar 700 to be variably positioned away from seat 100. Seat strap 600 may have other configurations as would be obvious to persons of ordinary skill in the art.

Figure 10:
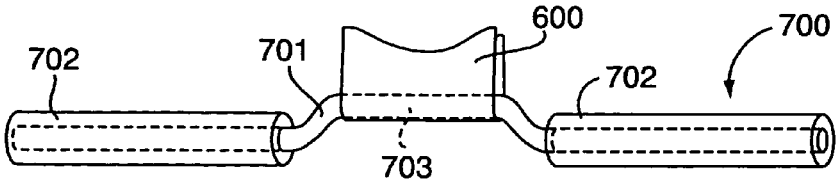
FIG. 10 is a top view of the stabilizing thigh bar 700 with a partial view of seat strap 600 according to an embodiment of the present invention.

As shown in FIG. 10, stabilizing thigh bar 700 includes bar 701 and pads 702 located at either end of bar 701. Stabilizing thigh bar 700 may be made of metal, plastic or any suitable material. Pads 702 may be foam rubber having a thickness ranging from approximately ¼ to ⅜ inches to aid in users' comfort. Alternatively, pads 702 may be cloth or other types of resilient padding. Seat strap 600 is located in a central portion 703 of stabilizing thigh bar 700. Central portion 703 may be offset or bent relative to the end portions of bar 701 in order to keep seat strap 600 from slipping to the sides.

As stated above, when a user attempts to do "sit-up" exercises, typically the user's knees do not remain stationary and either move up or down as the user is attempting to do a "sit-up". Thus, the user's ankles move either upward and/or away from the user's buttock. Many times, the user attempts to compensate for this by exerting muscular force to hold his feet down to the floor. Many times, the user will have a second person hold the user's feet stationary while the user does the sit-up exercises. Device 50 of the present invention eliminates these problems. Moreover, device 50 may be used in several different ways to achieve effective contraction of the hamstring muscles.

When a user desires to use device 50, the user places device 50 on a flat surface, e.g. floor, and positions device 50 such that (i) midpoint 224 of flex members 200 is positioned posteriorly and/or medially with respect to the user's knees, (ii) seat 100 is placed against the user's buttocks or posterior thighs and (iii) the user's ankles are positioned against ankle support members 310 as shown in FIGS. 3,4 and 5. The user may position his legs in a variety of ways in order to achieve optimum results. For example, it has been found that optimum results are achieved if the user positions his legs in a bend between about 60 degrees and 120 degrees with the femur and the tibia approximately 45 degrees with respect to the floor. It also has been found that optimum results can be achieved if the user raises his legs such that the knees are bent about 90 degrees and the femur is substantially perpendicular to the floor and the tibia is substantially parallel to the floor. Although the foregoing discussion describes specific angular positions of the user's legs, it is to be understood that the actual angular orientation of the user's legs may vary with each different user of device 50.

If seat strap 600 and seat stabilizing bar 700 are used, then the user configures the flexible seat strap into a loop, positions the loop between his legs, inserts bar 700 into the loop and positions bar 700 such that when the loop is tightened, bar 700 is pressed against the anterior thighs of the user.

The user is now ready to commence exercising using device 50. In one method, the user lies on his back and maintains his feet on the floor while simultaneously maintaining the ankles in contact with ankle support members 310. During this method, the user moves his feet toward his gluteus maximus muscle so as to bend flex member(s) 200 whereby the resistance of flex members 200 induces contraction of his hamstring muscles. The user then performs a sit-up.

In another method of using device 50, the user lies on her back and raises her feet between about ½" and 3 inches above the floor while simultaneously maintaining the ankles in contact with ankle support members 310. The user then moves her feet toward her gluteus maximus muscle so as to bend flex member(s) 200 whereby the resistance of flex member(s) 200 induces contraction of the hamstring muscles. While maintaining this position, the user then performs a sit-up.

In a further method of using device 50, the user lies on his back and raises his legs by pivoting the femurs at the hips (bent knee leg raises) while simultaneously maintaining the ankles in contact with the ankle support members 310. To gain a more intense workout, weight attachment member 401 and weights 404 can be secured to ankle frame attachment member 400 in order to effect a desired increased level of workout. The user moves his feet toward his gluteus maximus muscle so as to bend flex members 200 whereby the resistance of flex members 200 induces contraction of the hamstring muscles. While maintaining this position, the user performs a reverse-torso crunch.

In a further method, the user again lies on his back and raises his legs by pivoting the femurs at the hips (bent knee leg raises) while simultaneously maintaining the ankles in contact with the ankle support members 310. Again, weights may be used to increase the intensity of the workout. The user moves his feet toward his gluteus maximus muscle so as to bend flex members 200 whereby the resistance of flex members 200 induces contraction of the hamstring muscles. The user then performs a V-crunch. This is accomplished by pivoting the femurs toward the hip or torso line (from about 45 degrees to about 90 degrees) while simultaneously contracting the rectus abdominus and/or obliques, thereby raising the shoulders off of the floor while performing a sit-up.

Thus, the contact between the user's buttocks (and/or the rear portions of the user's thighs) and seat 100, and the force exerted upon ankle support members 310 by the user's ankles while the user is attempting to perform a sit-up effect a resultant compressive force on end portions 220 and 222 of flex members 200. Since flex members 200 are resilient, the aforementioned compressive force causes end portions 220 and 222 to approach each other. Preferably the resistance of flex members 200 is sufficient to prevent end portions 220 and 222 from contacting each other.

The user can achieve optimum abdominal conditioning in relatively less time by adding weights 404 so as to increase the force needed to be overcome in order to achieve proper contraction of the hamstrings.

Muscle strengthening device 50 of the present invention effects contraction of the hamstrings by squeezing the hamstrings, in effect, moving the ankles toward the buttocks simultaneously with contraction of the abdominal muscles. Device 50 of the present invention effects strengthening of the abdominal muscles while simultaneously inhibiting contraction of the psoas. Specifically, as muscle strengthening device 50 contracts the hamstrings, device 50 inhibits the psoas thereby providing maximum efficiency in strengthening the abdominal muscles. Seat 100 facilitates an optimum pelvic posterior tilt thereby maximizing the efficiency in strengthening and toning the abdominal muscles and obliques. Seat 100 further allows the user to roll to the side to perform exercises for the obliques. Use of device 50 also strengthens and tones the hamstring muscles and gluteus maximum.

Muscle strengthening device 50 of the present invention achieves proper rectus abdominal contraction and maximizes efficiency in strengthening the abdominal muscles and obliques. Device 50 effects neuro inhibition to substantially eliminate use of the hip flexors. As the user does a sit-up, device 50 causes contraction of the antagonistic muscles of the hip flexors, i.e. the gluteus maximum and hamstrings. Device 50 effects contraction of these muscles to substantially eliminate activity of the hip flexors thereby achieving isolated rectus abdominis contraction.

Thus, the device 50 of the present invention maximize the efficiency in toning and strengthening abdominal muscles, lower abdominal muscles (separate from "hip flexors") and obliques, tone and strengthen other muscles, e.g. hamstrings and gluteus maximum, simultaneously with and in addition to the abdominal muscles, facilitate correct pelvic tilt, achieve significant increases in strength of abdominal muscles over a relatively short period of time, and prevent over development of the iliopsoas or hip flexors. Furthermore, device 50 can be used with optional additional flex members and optional weights. Device 50 is lightweight and compact, inexpensive to manufacture, easy and convenient to use, and transportable and easy to store. Device 50 also allows users of different sizes or heights to use the device of the present invention in a comfortable and efficient manner.

While the present invention has been particularly described, in conjunction with a specific preferred embodiment, it is evident that many alternatives, modifications and variations will be apparent to those skilled in the art in light of the foregoing description. For example, it is within the scope of the present invention for the devices to be provided with one, two or more flex members 200. It is therefore contemplated that the appended claims will embrace any such alternatives, modifications and variations as falling within the true scope and spirit of the present invention.

What is claimed is:

1. A strength conditioning device comprising:

a plurality of flex members, each flex member having a first end portion, a second end portion and a middle portion between the first and second end portions, each middle portion having a curved region, and wherein the flex members are fabricated from one of the group consisting of plastic, ABS plastic, flexiglass, fiberglass composite material, graphite composite material, spring steel, and a combination thereof;

a seat having an upper surface for receiving the buttocks and/or upper posterior thigh portions of a user, the seat being attached to the second end portions of the plurality of flex members;

an ankle support attachment member attached to the first end portions of the plurality of flex members;

an ankle support frame attached to the ankle support attachment member, the ankle support frame having left and right ankle support members oppositely positioned on either side of the flex member for supporting the ankles of the user, the left and right ankle support members being located adjacent one end of the ankle support frame, which has a central frame portion extending away from the left and right ankle support members; and a forefoot bar attached to the ankle support frame, the forefoot bar having left and right forefoot support members and a center slot configured to slide over the central frame portion of the ankle support frame.

2. The device of claim 1, wherein the first end portion of at least one of the plurality of flex members has one of a series of through holes and a slot for adjustably attaching the flex member to the ankle support attachment member.

3. The device of claim 1, wherein the second end portion of at least one of the plurality of flex members has one of a series of through holes and a slot for adjustably attaching the flex member to the seat.

4. The device of claim 1, wherein the forefoot bar is removably and adjustably attachable to the ankle support frame.

5. The device of claim 1, wherein each forefoot support member has a forefoot contact area, which has a substantially circular cross-sectional shape and which includes padded material.

6. The device of claim 1, wherein the seat is attached to the second end portions of the flex members at a single point of attachment, and wherein the seat has a first position for when the user is operating the device and a second position, wherein the seat is swiveled relative to its first position approximately 90 degrees around its point of attachment the seat in the second position providing a more compact device than when the seat is in the first position.

7. The device of claim 1, wherein the ankle support frame has a plurality of pivot points configured to adjustably and pivotally attach the ankle support frame to the ankle frame attachment member, such that the left and right ankle support members can be positioned at various distances from and various angles to the ankle frame attachment member.

8. The device of claim 1, further comprising weight securing means for removably securing at least one weight to the device.

9. The device of claim 8, wherein the weight securing means includes a weight attachment member configured to attach to the ankle support attachment member, a post extending from the weight attachment member, and a clip rotatably positioned on the post.

10. The device of claim 1, further comprising a seat strap attached to a center portion of the seat and a stabilizing thigh bar coupled to the seat strap.

11. The device of claim 10, wherein the stabilizing thigh bar is removably coupled to the seat strap and the seat strap is configured to located the stabilizing thigh bar at a plurality of distances from the seat.

12. The device of claim 1, wherein the seat has a lower surface, opposite the upper surface, the lower surface having a central recessed cavity to accommodate the second end portions of the flex members.

13. The device of claim 1, wherein the seat has a lower surface, opposite the upper surface, the lower surface having a plurality of cavities separated by ribs.

14. A strength conditioning device comprising:

at least one flex member, the flex member having a first end portion, a second end portion and a middle portion between the first and second end portion, the middle portion having a curved region;

a seat having an upper surface for receiving the buttocks and/or upper posterior thigh portions of a user, the seat being attached to the second end portion of the flex member;

an ankle support attachment member attached to the first end portion of the flex member;

an ankle support frame attached to the ankle support attachment member, the ankle support frame having left and right ankle support members oppositely positioned on either side of the flex member for supporting the ankles of the user; and a forefoot bar coupled to the ankle support frame, the forefoot bar having left and right forefoot support members and being adjustably positionable for positioning the forefoot bar at different distances from the left and right ankle support members.

15. The device of claim 14, wherein each forefoot support member has a forefoot contact area, which has a substantially circular cross-sectional shape and which includes padded material.

16. The device of claim 14, further comprising a second flex member, wherein the flex members are adjustably attached to the seat and adjustably attached to the ankle support attachment member.

17. The device of claim 14, further comprising a seat strap attached to a center portion of the seat and a stabilizing thigh bar coupled to the seat strap, wherein the seat strap is configured to located the stabilizing thigh bar at a plurality of distances from the seat.

* * * * *